US006691676B2

(12) United States Patent
Konno

(10) Patent No.: US 6,691,676 B2
(45) Date of Patent: Feb. 17, 2004

(54) ENGINE WARM-UP CONTROL METHOD

(75) Inventor: Atsushi Konno, Fujisawa (JP)

(73) Assignee: Isuzu Motors Limited, Tokyo (JP)

( * ) Notice: Subject to any disclaimer, the term of this patent is extended or adjusted under 35 U.S.C. 154(b) by 40 days.

(21) Appl. No.: 10/172,847

(22) Filed: Jun. 14, 2002

(65) Prior Publication Data

US 2003/0019472 A1 Jan. 30, 2003

(30) Foreign Application Priority Data

Jun. 18, 2001 (JP) ..... 2001-183487

(51) Int. Cl.[7] ..... F02M 51/00; F02D 41/06; F02D 41/08

(52) U.S. Cl. ..... 123/339.24; 123/491

(58) Field of Search ..... 123/339.24, 491

(56) References Cited

U.S. PATENT DOCUMENTS

| | | | | |
|---|---|---|---|---|
| 4,088,109 A | * | 5/1978 | Woodruff et al. | 123/179.21 |
| 4,246,639 A | * | 1/1981 | Carp et al. | 123/491 |
| 4,964,386 A | | 10/1990 | Akiyama et al. | 123/339 |
| 5,662,084 A | | 9/1997 | Deguchi et al. | 123/339 |
| 5,929,533 A | | 7/1999 | Streib | 307/10.1 |
| 6,009,857 A | * | 1/2000 | Hasler et al. | 123/481 |
| 6,209,313 B1 | | 4/2001 | Wissler et al. | 60/274 |
| 6,354,266 B1 | * | 3/2002 | Cornell et al. | 123/322 |
| 6,523,525 B1 | * | 2/2003 | Hawkins | 123/491 |

FOREIGN PATENT DOCUMENTS

| | | |
|---|---|---|
| JP | 59-180041 | 10/1984 |
| JP | 60-256538 | 12/1985 |
| JP | 63-001739 | 1/1988 |
| JP | 08-312417 | 11/1996 |

OTHER PUBLICATIONS

Copy of EP Search Report for Serial No. 02 01 3177 dated Oct. 10, 2003.

* cited by examiner

*Primary Examiner*—Erick Solis
(74) *Attorney, Agent, or Firm*—McCormick, Paulding & Huber LLP

(57) ABSTRACT

In order to reduce white smoke emissions immediately after start-up, the present invention is a method for executing engine warm-up control using electronic control units, wherein start-up idle control which does not perform the prescribed fast idle control, is executed until a prescribed period of time t1 has elapsed after engine start-up, whereupon the amount of fuel injection is increased to execute fast idle control. Immediately after engine start-up, the fuel injection amount and number of engine revolutions are restricted compared to those during fast idle control, preventing a large amount of fuel injection and high number of revolutions while the piston wall surface temperature is low, and thereby significantly reducing white smoke emissions.

2 Claims, 3 Drawing Sheets

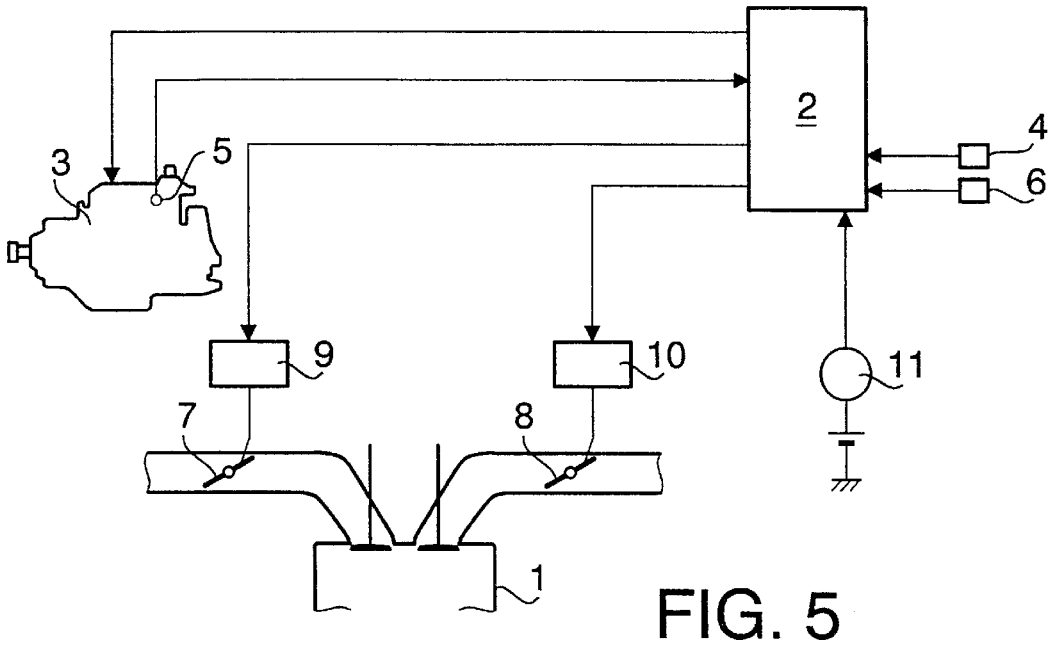
FIG. 5
FIG. 6
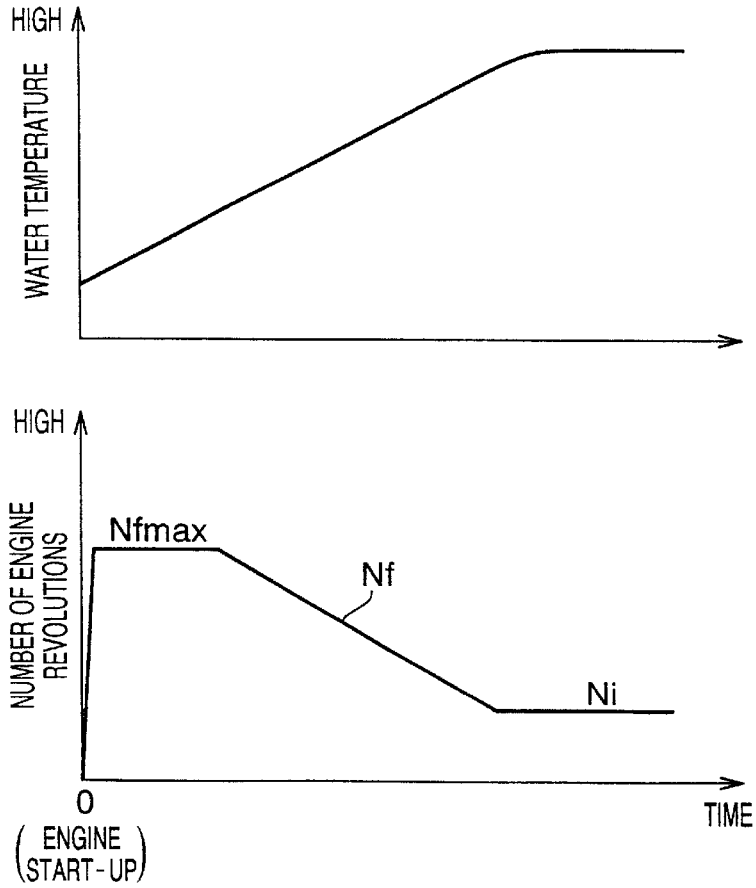

ENGINE WARM-UP CONTROL METHOD

This application is entitled to the benefit of and incorporates by reference essential subject matter disclosed in Japanese Patent Application No. 2001-183487 filed Jun. 18, 2001.

BACKGROUND OF THE INVENTION

1. Field of the Invention

The present invention relates to a warm-up control method for an electronically controlled engine which is installed in vehicles and the like.

2. Description of the Related Art

Generally in electronically controlled engines installed in vehicles and the like, fast idle control for raising the number of idle revolutions higher than the ordinary number of revolutions is executed to enhance warm-up after the engine has been started up. In other words, as is shown in FIG. 6, from the time of engine start-up until the water temperature reaches a prescribed temperature, the amount of fuel injection supplied to the engine is greater than the amount corresponding to the ordinary number of idle revolutions Ni, and control is conducted so as to raise the number of engine revolutions higher than the ordinary number of idle revolutions Ni. The main parameter that determines the number of fast idle revolutions Nf is water temperature, and other parameters such as intake-air temperature may also be included. In the example shown in the drawings, control is carried out whereby for a prescribed period of time after engine start-up the maximum number of fast idle revolutions Nfmax is maintained, and thereafter, as the water temperature rises, the number of fast idle revolutions Nf is gradually lowered, and eventually the ordinary number of idle revolutions Ni is reached.

However, when this kind of fast idle control is carried out in an in-cylinder injection engine in which fuel is injected directly into a cylinder, the wall surface temperature of the piston has not yet risen sufficiently immediately after start-up, and so fuel that adheres to the piston wall surface when injected into the cylinder does not evaporate and is discharged outside the cylinder in that state, leading to the emission of a large amount of white smoke. Moreover, since the number of engine revolutions is set high during fast idle control, an even greater amount of white smoke is emitted.

SUMMARY OF THE INVENTION

Consequently, the present invention was designed with the foregoing problems in view, and it is an object thereof to reduce the amount of white smoke emitted immediately after start-up.

The present invention is a method for executing engine warm-up control using electronic control units, wherein start-up idle control, which does not perform the prescribed fast idle control is carried out until a prescribed period of time has elapsed after engine start-up, whereupon the fuel injection amount is increased and fast idle control is executed.

Immediately after engine start-up, start-up idle control is carried out to restrict the fuel injection amount to a value nearly corresponding to the number of idle revolutions. Since this is lower than during fast idle control, a situation in which there is a large amount of fuel injection and a high number of revolutions while the piston wall surface temperature is still low is prevented, and the amount of white smoke emitted can be significantly reduced.

Further, the present invention is a method for performing engine warm-up control using electronic control units, wherein start-up idle control for setting the fuel injection amount at a level producing the minimum amount of white smoke emissions, is executed until a prescribed period of time has elapsed after engine start-up, whereupon the fuel injection amount is increased, and fast idle control is executed.

BRIEF DESCRIPTION OF THE DRAWINGS

FIG. 5 is a compositional view showing an engine control device according to the present embodiment; and FIG. 6 is a time chart showing the nature of conventional fast idle control.

DESCRIPTION OF THE PREFERRED EMBODIMENTS

Figure 1:
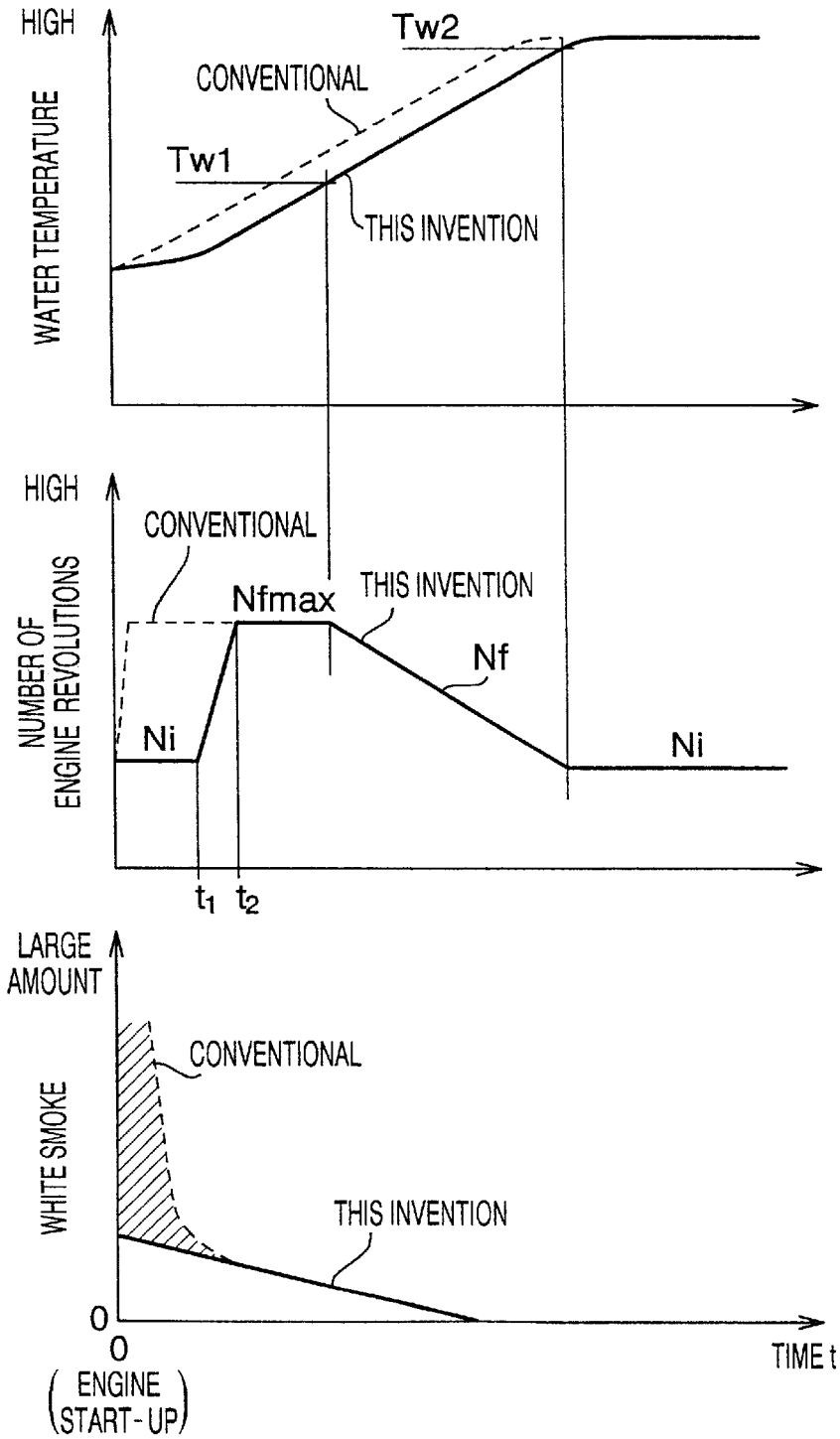
FIG. 1 is a time chart showing the nature of warm-up control according to the present embodiment, wherein the upper section shows water temperature, the middle section shows the number of engine revolutions and the lower section shows the amount of white smoke.

Preferred embodiments of the present invention will be described below on the basis of the attached drawings.

FIG. 5 shows an engine warm-up control device according to the present embodiment. An engine 1 is an in-cylinder injection engine in which fuel is injected directly into a cylinder, and in this case is a diesel engine. Further, the engine 1 is an electronically controlled-type for electronically controlling the amount of fuel injection and the injection time, comprising a fuel injection pump 3 wherein the amount of discharged fuel is controlled by an electronic control unit 2. As means for detecting engine temperature, a water temperature sensor 4 is provided to detect the coolant temperature of the engine; as means for detecting the revolution speed of the engine, an engine revolution sensor 5 is provided; and as means for detecting intake-air temperature, an intake-air temperature sensor 6 is provided. These sensors 4, 5 and 6 are connected to the electronic control unit 2. The electronic control unit 2 reads the water temperature from the outputs of these sensors 4, 5 and 6, and the number of engine revolutions is calculated as the engine revolution speed while the intake-air temperature is read. Further, the engine revolution sensor 5 is provided in the fuel injection pump 3, and the electronic control unit 2 converts the number of revolutions of the fuel injection pump 3 into the number of engine revolutions. An intake throttle valve 7 and an exhaust throttle valve 8 are provided in the intake passage and exhaust passage of the engine respectively. These throttle valves 7 and 8 are opened and closed by actuators 9 and 10 respectively. These actuators 9 and 10 are connected to the electronic control unit 2 and are activated and controlled by the electronic control unit 2. Reference numeral 11 depicts a key switch.

Warm-up control at the time of engine start-up is executed in the following manner. First, the key switch 11 turns on when the engine stops, and the actuators 9 and 10 are activated, closing the intake throttle valve 7 and the exhaust throttle valve 8. After the complete combustion of the engine 1, as the water temperature rises, the intake throttle valve 7 and the exhaust throttle valve 8 are opened. At the same time, the following warm-up control is executed.

The nature of this control is shown in the middle section of FIG. 1. First, from the time of engine start-up (time t=0) until a prescribed time t1 has elapsed, instead of the fast idle control that is conventionally performed (dotted line), start-up idle control is executed. More specifically, control of the fuel injection amount is executed so as to achieve the number of idle revolutions Ni to which the engine is pre-set, in other words, fuel is injected into the engine to correspond to that number of idle revolutions Ni. Explaining this in more detail, with the number of idle revolutions Ni as the target number of revolutions, the fuel injection amount is feedback controlled so that the actual number of engine revolutions accords with this target number of revolutions. Naturally the fuel injection amount at this time is less than the fuel amount during fast idle control. During start-up idle control, since the piston wall surface temperature has not yet risen sufficiently, it is desirable to make the number of engine revolutions as low as possible and to lower the fuel injection amount. In this case, the target number of revolutions is set to the number of idle revolutions Ni, but may also be set to a slightly higher or lower number of revolutions than this amount.

Thereafter, when the prescribed period of time t1 has elapsed, the fuel injection amount is increased so as to execute fast idle control. In other words, the fuel injection amount is increased to an amount greater than during start-up idle control, and the number of engine revolutions is increased, thereby enhancing warm-up. More specifically, based on the prescribed parameters (mainly water temperature and also intake-air temperature), a higher target number of revolutions than the number of idle revolutions Ni is determined and the fuel injection amount is feedback controlled so that the actual number of revolutions accords with this target number of revolutions. In the present embodiment, the lower the water temperature, the higher the target number of revolutions is set, and as the fuel injection amount increases, the maximum number of fast idle revolutions Nfmax, which is the upper limit of the target number of revolutions, is set. According to the example in the drawings, between the time t1 and the time t2, the number of engine revolutions is raised from the number of idle revolutions Ni to the maximum number of fast idle revolutions Nfmax, the maximum number of fast idle revolutions Nfmax until the water temperature rises to a prescribed temperature Tw1 is maintained, and from the time that the water temperature reaches the prescribed temperature Tw1, control is executed to lower the number of fast idle revolutions Nf as the water temperature rises. Then when the water temperature reaches a prescribed temperature Tw2 (>Tw1) fast idle control ends and warm-up control is complete.

In so doing, in this control, the number of engine revolutions is controlled to the number of idle revolutions Ni or close to this number for a fixed time immediately after start-up, and therefore during this time, the fuel injection amount can be reduced in comparison to conventional fast idle control, and the number of engine revolutions can be restricted. Accordingly, at a time when the piston wall surface temperature has not risen sufficiently, the amount of fuel that cannot evaporate is reduced, while exhaust gas emissions are also suppressed, thereby enabling a significant reduction in white smoke emissions. The shaded area shown in the lower section of FIG. 1 shows the extent of white smoke reductions. In other words, since the amount of fuel injection is increased only after the piston wall surface temperature has risen sufficiently, a large amount of fuel injection prior to this time is not executed so that white smoke emissions can be reduced.

Figure 3:
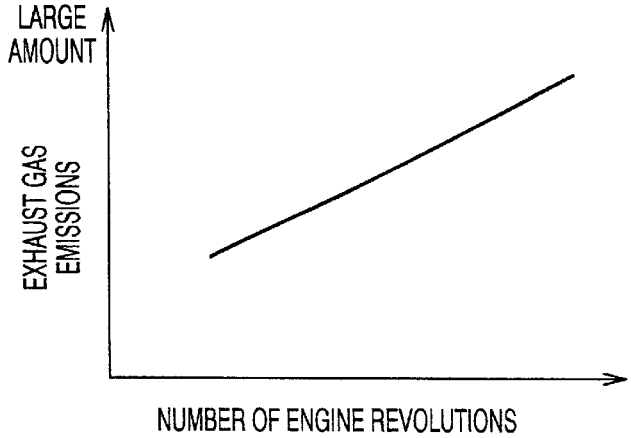
FIG. 3 is a graph showing the relationship between the number of engine revolutions and the amount of exhaust gas.

Note that due to this control as shown in the upper section of FIG. 1, the rise in water temperature is slightly slower and warm-up is slightly delayed. However since the piston wall surface temperature rises comparatively rapidly due to combustion inside the cylinder, the delay in warm-up is only very slight and poses no practical problem. The white smoke emissions shown in the lower section of FIG. 3 are the visible emissions.

In this case, the number of engine revolutions and time required for executing start-up idle control can be configured on the basis of factors including the characteristics of the particular engine, the water temperature, the outside air temperature, the timer, the fuel temperature and the engine speed variation (angular velocity variation). Further, this number of engine revolutions may be set differently to the set number of idle revolutions after the completion of warm-up control.

Figure 2:
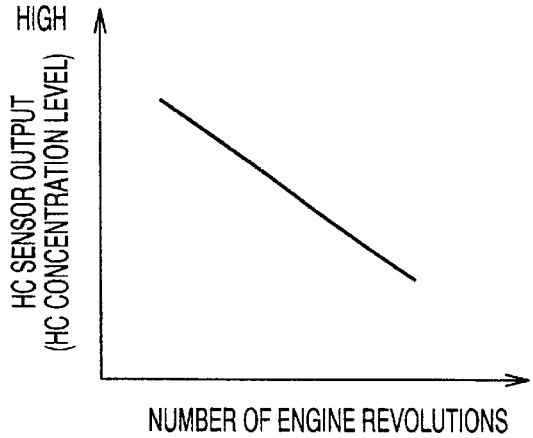
FIG. 2 is a graph showing the relationship between the number of engine revolutions and the HC concentration levels.
Figure 4:
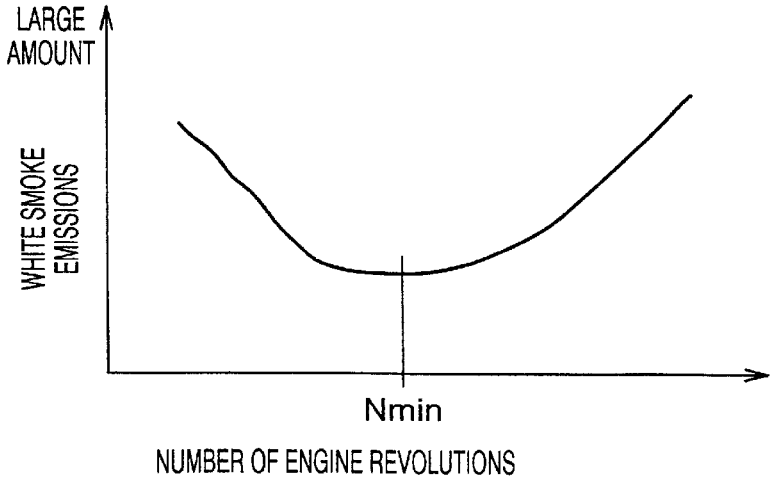
FIG. 4 is a graph showing the relationship between the number of engine revolutions and the amount of white smoke.

Further, start-up idle control may be designed to control the number of engine revolutions so that white smoke emissions are at a minimum. In order to achieve this, an HC sensor or smoke sensor (not shown in the drawings) is used to detect HC concentration levels in the exhaust gas inside the exhaust pipe. FIG. 2 shows the relationship between the number of engine revolutions and the output of the HC sensor, in other words the HC concentration levels. As can be seen from the drawing, when the number of engine revolutions is low, HC concentration levels at low temperatures are flame-out, or before this happens the HC may be emitted at a higher concentration. Further, as shown in FIG. 3, the amount of exhaust gas is greater the higher the number of engine revolutions. White smoke emissions can be thought of as the product of HC concentration levels and the amount of exhaust gas. Even when HC concentration levels are the same, if the number of engine revolutions is twice as high, the amount of visible white smoke emitted is twice as great. Accordingly, it can be seen that the relationship between the number of engine revolutions and white smoke emissions is as shown in FIG. 4, and that there is a number of engine revolutions Nmin where white smoke emissions are at a minimum. Accordingly, if this number of revolutions Nmin is made the target number of revolutions and the fuel injection amount is feedback controlled, white smoke emissions during start-up idle control can be kept at a minimum.

A variety of other embodiments of the present invention may be considered. For example, the engine can be an in-cylinder injection gasoline engine. The present invention would also be effective if applied to a premix engine, which is the main type of gasoline engine. Additionally, it can be applied to a diesel engine having a common rail-type fuel injection device, and it goes without saying that it may be applied to an engine that does not contain intake or exhaust throttle valves.

In short, the invention described above exhibits the superior effect of reducing white smoke emissions immediately after start-up.

What is claimed is:

1. An engine warm-up control method for executing engine warm-up control using electronic control units, wherein start-up idle control, which does not perform prescribed fast idle control, is executed until a prescribed period of time has elapsed after engine start-up, whereupon the amount of fuel injection is increased so as to execute this fast idle control.

2. An engine warm-up control method for executing engine warm-up control using electronic control units, wherein start-up idle control, which sets the fuel injection amount at a value producing the minimum amount of white smoke emissions, is executed until a prescribed period of time has elapsed after engine start-up, whereupon the amount of fuel injection is increased in order to execute the prescribed fast idle control.

* * * * *